United States Patent [19]

Strauss

[11] Patent Number: 4,778,427

[45] Date of Patent: Oct. 18, 1988

[54] NEGATIVE INTERFERENCE FIXTURING MEANS AND PROCESS FOR USE IN THE MANUFACTURE OF A TENSION MASK COLOR CATHODE RAY TUBE

[75] Inventor: Paul Strauss, Chicago, Ill.

[73] Assignee: Zenith Electronics Corporation, Glenview, Ill.

[21] Appl. No.: 60,135

[22] Filed: Jun. 9, 1987

[51] Int. Cl.[4] ..... H01J 9/227; H01J 9/20

[52] U.S. Cl. ..... 445/30; 445/45; 445/52; 445/68

[58] Field of Search ..... 445/30, 45, 52; 430/23, 430/24

[56] References Cited

U.S. PATENT DOCUMENTS

| | | | |
|---|---|---|---|
| 2,625,734 | 1/1953 | Law | 445/52 |
| 2,654,940 | 10/1953 | Law | 29/447 |
| 3,894,321 | 7/1975 | Moore | 445/30 X |
| 4,547,696 | 10/1985 | Strauss | 313/407 X |
| 4,591,344 | 5/1986 | Palac | 445/30 |
| 4,593,224 | 6/1986 | Palac | 313/407 X |
| 4,656,389 | 4/1987 | Palac | 445/68 X |
| 4,695,761 | 9/1987 | Fendley | 445/30 X |
| 4,721,488 | 1/1988 | Dougherty et al. | 445/30 |

OTHER PUBLICATIONS

Grimes et al., "Improvements in the RCA Three-Beam Shadow Mask Color Kinescope", Jan. 1954.

*Primary Examiner*—Kenneth J. Ramsey

[57] ABSTRACT

Negative interference fixturing means and process are disclosed for use in the photoexposure of an in-process faceplate assembly for a color cathode ray tube, and the attachment of a shadow mask to its support. The assembly includes a flat glass faceplate having on its inner surface a centrally disposed screening area for receiving a predetermined pattern of phosphor deposits, a shadow mask having a pattern of apertures corresponding to the pattern of phosphor deposits, and a shadow mask support structure located on opposed sides of the screening area for supporting the mask in tension. The negative interference fixturing means comprises shadow mask mounting means for mounting and locating the mask in tension in a proximate, but negative interference relationship with the mask support structure, and means for installing the faceplate on a photoexposure lighthouse in conjunction with the shadow mask mounting means, and for positioning the mounting means relative to the faceplate and the support structure such that the predetermined pattern of shadow mask apertures lies in precise registration with the screening area. The fixturing means also includes means for temporarily urging the shadow mask into uniform engagement with the support structure while maintaining the precise registration with the screening area, and means for photoexposing the screening area, and welding the mask to its support. As a result, precise registration of the screening area of the faceplate with the shadow mask apertures is accomplished without frictional constraint between the shadow mask support structure and the mask.

19 Claims, 7 Drawing Sheets

NEGATIVE INTERFERENCE FIXTURING MEANS AND PROCESS FOR USE IN THE MANUFACTURE OF A TENSION MASK COLOR CATHODE RAY TUBE

CROSS-REFERENCE TO RELATED APPLICATIONS AND PATENTS

This application is related to but in no way dependent upon copending application Ser. No. 583,003 now U.S. Pat. No. 4,721,879; Ser. No. 831,696 now U.S. Pat. No. 4,721,488; Ser. No. 832,493 now U.S. Pat. No. 4,695,761; Ser. No. 832,556 now U.S. Pat. No. 4,730,143; Ser. No. 140,019 filed Dec. 31, 1987; Ser. No. 58,095 filed June 4, 1987; Ser. No. 131,968 filed Dec. 11, 1987; Ser. No. 51,896 filed May 18, 1987; and U.S. Pat. Nos. 3,894,321; 4,069,567; 4,547,696; 4,591,344; 4,593,224; 4,595,857; and 4,656,388, all of common ownership herewith.

This specification includes an account of the background of the invention, a description of the best mode presently contemplated for carrying out the invention, and appended claims.

BACKGROUND OF THE INVENTION

1. Field of the Invention

This invention relates to color cathode ray picture tubes, and is addressed specifically to improved means and process for the manufacture of tubes having a tensed foil shadow mask. Color tubes of various types that have a tension foil mask can be manufactured by the process, including those used in home entertainment television receivers. The process according to the invention is particularly valuable in the manufacture of medium-resolution, high-resolution, and ultra-high resolution tubes intended for color monitors.

The use of the foil-type flat tension mask and flat faceplate provides significant benefits in comparison to the conventional domed shadow mask and correlatively curved faceplate. Chief among these is a greater power-handling ability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. When heated, the tensed mask distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tensed foil shadow mask is a part of the cathode ray tube faceplate assembly, and is located in close adjacency to the faceplate. The faceplate assembly comprises the faceplate with its screen, which consists of deposits of light-emitting phosphors, a shadow mask, and support means for the mask. As used herein, the term "shadow mask" means an apertured metallic foil which may, by way of example, be about 0.001 inch or less in thickness. The mask must be supported under high tension a predetermined distance from the inner surface of the cathode ray tube faceplate; this distance is known as the "Q-distance." As is well known in the art, the shadow mask acts as a color-selection electrode, or "parallax barrier," that ensures that each of the three electron beams lands only on its assigned phosphor elements.

The conventional process of depositing patterns of color phosphor elements on the screening surface of a color picture tube faceplate utilizes the well-known photoscreening process. A shadow mask, which in effect functions as a perforated optical stencil, is used in conjunction with a light source to expose in successive steps, at least three light-sensitive photoresist patterns on the screening surface. The shadow mask is typically "mated" to each faceplate; that is, the same mask is used in the production of a specific tube throughout the production process, and is permanently installed in the tube in final assembly. Typically, four engagements and four disengagements of the mask, as well as six exposures, are required in the standard photoscreening process. In certain of the processes, a "master" may be used for exposing the photoresist patterns in lieu of a shadow mask permanently mated to the faceplate and its screen.

2. Prior Art

There have been a number of disclosures of tensed foil masks and means for applying tension to the mask and retaining the mask under tension. Typical of these is the disclosure of Law in U.S. Pat. No. 2,625,734 which addresses the construction of a taught, planar foraminous mask. A foil mask blank is loosely mounted in a two-section frame, and the mask is expanded by the hot-blocking process. Machine screws peripheral to the frame provide for clamping the mask tightly in the frame when the mask is in its expanded state. The mask becomes tense upon cooling as it is restrained from returning to its former dimensions by its captivation by the frame. The frame with the mask enclosed is mounted with the phosphorbearing screen as a unitary assembly adjacent to the inner surface of the faceplate. Law in U.S. Pat. No. 2,654,940 also discloses means for stretching and captivating by frames masks formed from wire mesh.

U.S. Pat. No. 3,894,321 to Moore, of common ownership herewith, is directed to a method for processing a color cathode ray tube faceplate in conjunction with a thin foil tension shadow mask. A frame with a screw-clamp system for clamping the foil supports a tensed mask during lighthouse exposure of an associated screen. The faceplate is registered with the mask support frame by means of three alignment posts which extend from the lighthouse, and against which the frame and the faceplate are both biased by gravity. The faceplate and frame, being both referenced to the three lighthouse posts, are thereby referenced to each other.

In U.S. Pat. No. 4,591,344 to Palac, of common ownership herewith, a method of making a color cathode ray tube is disclosed in which a frame on which a shadow mask is stretched has indexing means cooperable with registration-affording means on a faceplate. The assembly provides for multiple registered matings of the faceplate and mask during photoscreening operations. A photographic plate is used in a process for applying the phosphor elements to the faceplate screening area to provide an interchangeable mask system; this in lieu of the more common method of using a shadow mask permanently mated with a faceplate, and which serves as an optical stencil during the photoscreening process. The sealing areas of the faceplate and the frame are joined in a final assembly operation such that the frame becomes an integral constituent of the cathode ray tube.

A mask registration and supporting system for a cathode ray tube having a rounded faceplate with a skirt for attachment to a funnel is disclosed by Strauss in U.S. Pat. No. 4,547,696 of common ownership herewith. The skirt of the faceplate provides the necessary Q-distance between the mask and the screen. A frame dimensioned to enclose the screen comprises first and second space-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. Following final assembly, the frame is permanently fixed in place within the tube envelope between the sealing lands of the faceplate and a funnel, with a stiffening member projecting from the frame into the funnel.

In U.S. Pat. No. 4,593,224 to Palac, of common ownership herewith, there is disclosed a shadow mask mount in the shape of a rectangular frame for use in tensing an in-process shadow mask, and for temporarily supporting the mask while in tension. An apertured foil comprising the in-process mask is laid across the opening in the frame and is secured to the frame by brazing or welding. The coefficient of thermal expansion of the foil is preferably equal to or slightly less than that of the frame. A glass frame is also provided that consists of two identical rectangular members smaller in circumferential dimension than the metal frame. When joined into a single frame, the members are located between the tube faceplate and funnel to become an integral part of the tube envelope in final assembly. Each member of the glass frame has indexing means, one member for indent-detent registration with the faceplate, and the other for indent-detent registration with the funnel. Following the application of a layer of devitrifying cement in paste form to the facing surfaces of the two members, the mask, held in the metal frame, is sandwiched between the two members. As the assembly is heated, the expansion of the mask is taken up by screw means attached to the metal frame which press against the peripheries of the members. Upon cooling of the assembly, the coefficient of thermal expansion of the mask, being greater than that of the glass, results in the mask being held permanently in tension by the glass frame through the medium of the frit cement, which has become solidified by the heat. The portion of the mask that projects beyond the periphery of the glass frame is severed to release the metal frame. The glass frame with its captivated mask is then mounted on a lighthouse for photoscreening of the faceplate, with registration with the light-house and faceplate provided by the indent-detent means described.

In referent U.S. Pat. No. 4,721,488 of common ownership herewith, there is disclosed an apparatus for tensing a foil shadow mask. The apparatus comprises a pedestal having registration-affording means, and a tensing structure which includes a fixture comprising a pair of collars for clamping the edge of a foil to support and maintain the foil in a taut condition. An anvil is provided for engaging a peripheral portion of the clamped foil to induce deflection of the foil, and thereby, a predetermined tension in the foil. Following a photoscreening process, the mask is secured to shadow mask supports extending from the faceplate by welding.

In a journal article, there is described means for mounting a flat tensed mask on a frame for use in a color cathode ray tube having a circular faceplate with a curved viewing surface. In one embodiment, the mask, which is also circular, is described as being welded to a circular frame comprised of a ⅛-inch steel section. The frame with captivated mask is mounted in spaced relationship to a phosphor dot plate, and the combination is assembled into the tube as a package located adjacent to the faceplate. ("Improvements in the RCA Three-Beam Shadow Mask Color Kinescope," by Grimes et al. The IRE, January 1954; decimal classification R583.6.)

OBJECTS OF THE INVENTION

It is a general object of this invention to provide means and a process for facilitating the manufacture of color cathode ray tubes having a tensed foil shadow mask.

It is an object of this invention to provide improved fixturing means capable of facilitating the manufacture of color cathode ray tubes having a tensed foil shadow mask.

It is another object of this invention to provide improved fixturing means for use in the manufacture of an in-process faceplate assembly comprising a tensed foil shadow mask and faceplate.

It is a further object of this invention to provide means for ensuring uniform contact between a foil shadow mask and a shadow mask support structure.

It is another object of the invention to improve laser weld integrity while reducing the beam energy requirements.

It yet is another object of the invention to provide means and a process capable of precise registration of a foil mask with a phosphor screen without interference from parts that are mated during manufacture.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DESCRIPTION OF THE PREFERRED EMBODIMENT

To facilitate understanding of the negative interference fixturing means and process according to the invention, and their relation to the manufacture of a tensed foil mask cathode ray tube, a brief description of a tube of this type and its components is offered in following paragraphs.

Figure 1:
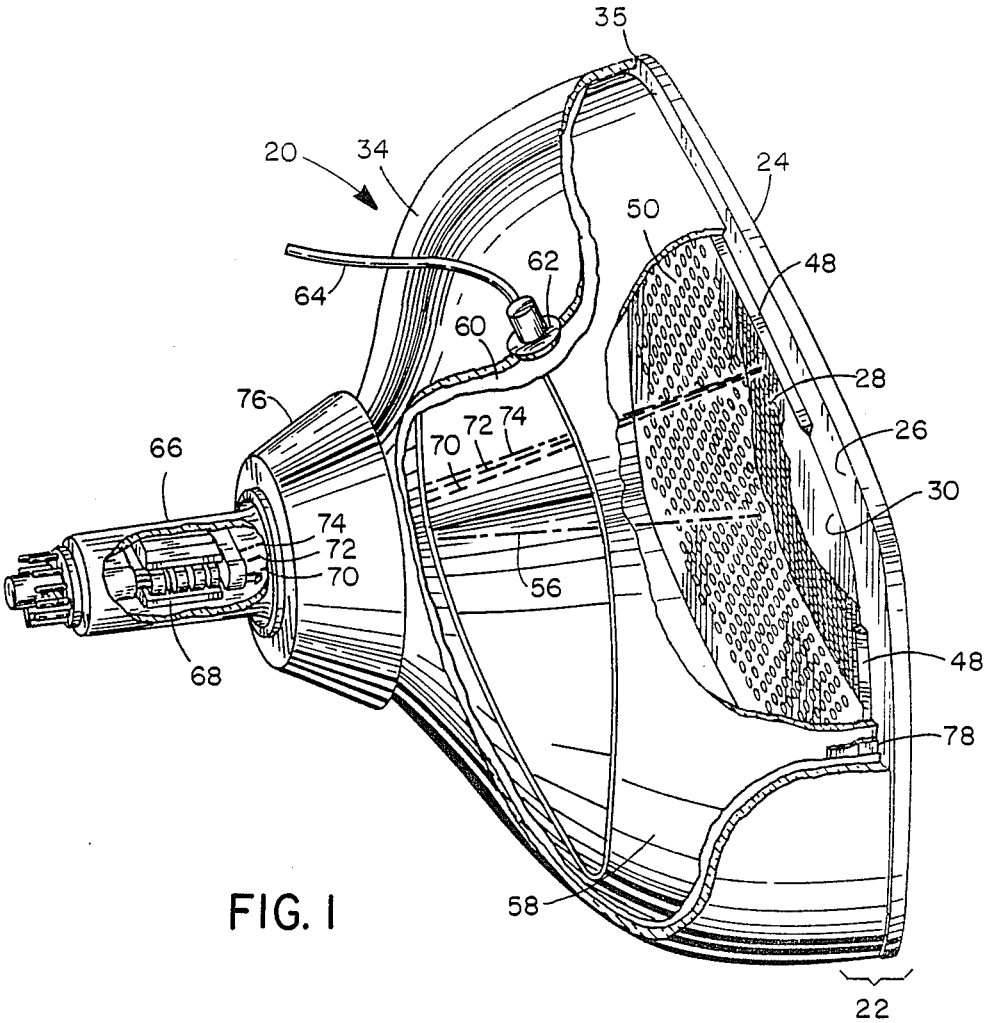
FIG. 1 is a side view in perspective of a color cathode ray tube having a flat faceplate and a tensed foil shadow mask, with cut-away sections that indicate the location and relation of the faceplate and shadow mask to other major tube components.

A color cathode ray tube 20 having a tensed foil shadow mask is depicted in FIG. 1. The faceplate assembly 22 of tube 20 includes a flat glass faceplate 24 having on its inner surface 26 a centrally disposed phosphor screen 28 with a predetermined pattern of phosphor deposits thereon. A film of aluminum 30 is indicated as covering the screen 28. A funnel 34 is represented as being attached to faceplate assembly 22 at their interfaces 35. A shadow mask support structure 48 provides for mounting a metal foil shadow mask 50 which has a pattern of apertures corresponding to the pattern of the phosphor deposits on screen 28. The shadow mask support structure 48 is indicated as being located on opposed sides of the screening area for supporting mask 50 in tension.

The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 34 by way of an anode button 62 connected in turn to a high-voltage conductor 64.

The neck 66 of tube 20 is represented as enclosing an in-line electron gun 68 depicted as providing three discrete in-line electron beams 70, 72 and 74 for exciting respective red-light-emitting, green-light-emitting, and blue-light-emitting phosphor elements on screen 28. Yoke 76 receives scanning signals and provides for the scanning of beams 70, 72 and 74 across screen 28. A metal contact spring 78 provides an electrical path between the funnel coating 60 and mask support structure 48.

A component termed a "factory fixture frame" is described in some length in the following to facilitate understanding of the present invention. The frame may comprise a component of the negative interference fixturing means according to the invention. The factory fixture frame is represented as having a number of six-point indexing means that provide for high precision in the registration and re-registration of a foil in-process shadow mask with a faceplate, and registration with production machinery during manufacture. The factory fixture frame, noted as being reusable, is fully described and claimed in referent copending application Ser. No. (51,896) of common ownership herewith.

In-process shadow mask tensing and clamping means having configurations different from that of the factory fixture frame described herein may as well be used, as the implementation of the present invention is not dependent upon this particular frame. However, any substitute must be able to provide the high precision and versatility required in the manufacture of tension mask cathode ray tubes.

Figure 2:
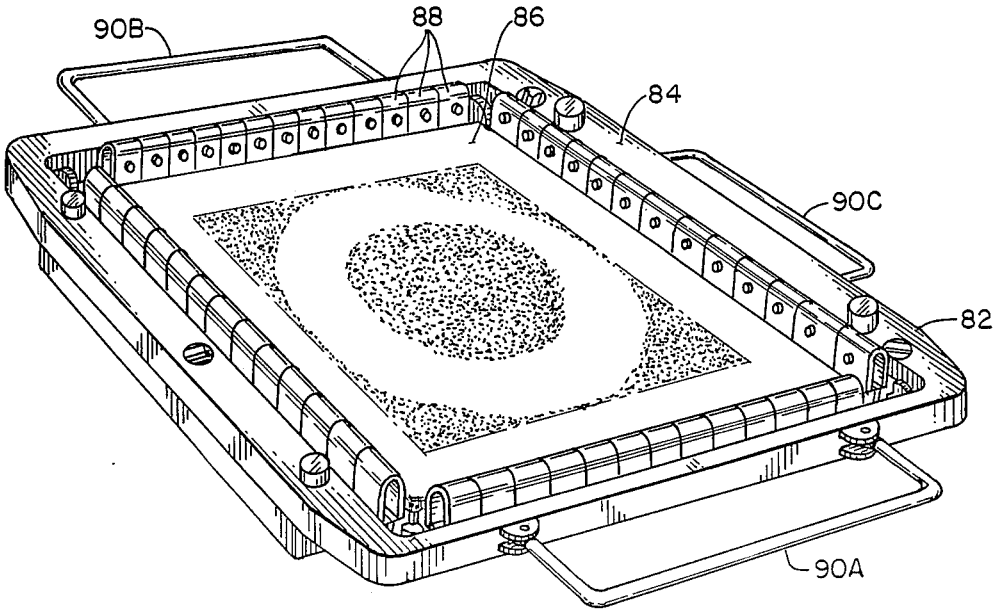
FIG. 2 is an oblique view in perspective of a factory fixture frame with an in-process shadow mask mounted in tension therein.

A factory fixture frame 82 is shown in FIG. 2; a first side 84 of frame 82 is indicated. The frame 82 is intended for use in the manufacture of a color cathode ray tube of the type shown by FIG. 1. As depicted in FIG. 2, reusable factory fixture frame 82 comprises a generally rectangular frame means and quick-release mechanical mask-retaining means for temporarily and removably supporting an in-process shadow mask 86 in tension by means of mechanical mask-retaining means, shown as being in the form of a series of discrete spring clip means 88. The spring clip means of mask tensing and clamping is described and claimed in referent copending application Ser. No. (140,019) of common ownership herewith. Essentially, the factory fixture frame 82 comprises shadow mask mounting means for mounting and locating a shadow mask in tension in a proximate, but negative interference relationship with the mask support structure; that is, and in accord with the invention, in close proximity to, but not touching the structure.

Factory fixture frame 82 will be noted as having handles 90A, 90B and 90C for convenience in handling during manufacture. Handles 90A and 90B provide for lifting the removing the factory fixture frame 82 from production machinery such as a mask tensing-clamping machine.

Figure 3:
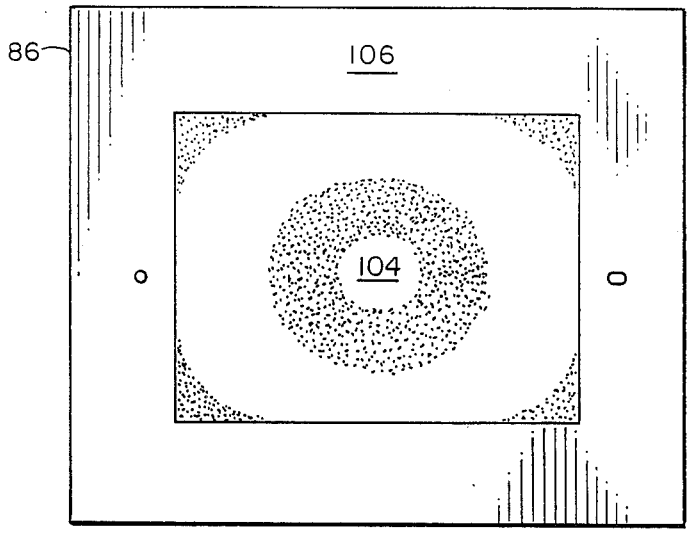
FIG. 3 is a plan view of an in-process foil shadow mask.

An in-process shadow mask is indicated in FIG. 3 prior to its installation in the factory fixture frame 82. In-process shadow mask 86 includes a center field 104 of apertures corresponding to the pattern of phosphor deposits to be photoscreened on the screening area 112 of faceplate 108. Center field 104 is indicated as being surrounded by an unperforated section 106, the periphery of which is engaged during the mask tensing and clamping process. Section 106 is trimmed off in a later operation as will be described.

Figure 4:
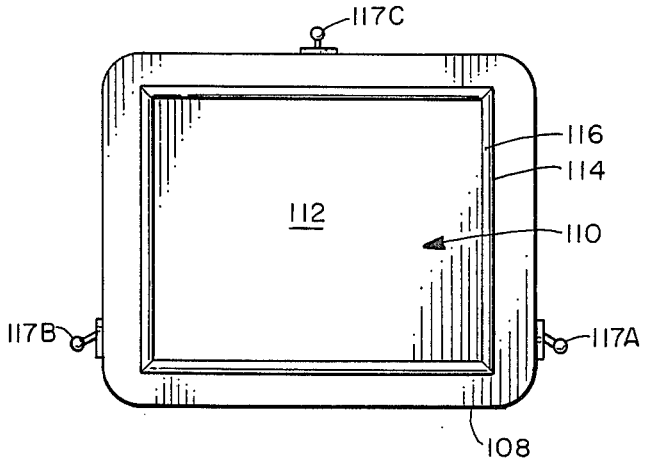
FIG. 4 is a plan view of an in-process flat glass faceplate showing the screening area, a shadow mask support, and faceplate indexing means extending from the sides thereof.

An in-process faceplate 108 is depicted diagrammatically in FIG. 4 as having on its inner surface 110 a centrally disposed screening area 112 for receiving a predetermined pattern of phosphor deposits in an ensuing operation. A shadow mask support structure 114 is indicated as being located on opposed sides of screening area 112; the structure provides for supporting a foil shadow mask in tension. Support structure 114 is indicated as having a surface 116 which provides for receiving mask 86. Ball means 117A, 117B and 117C, which are components of six-point indexing means, are indicated as extending from the sides of faceplate 108.

Figure 5:
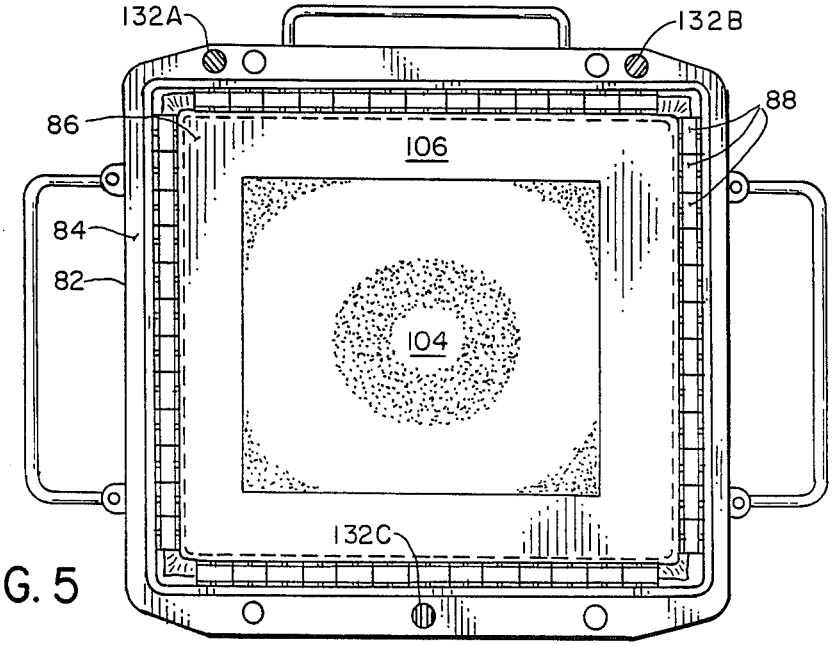
FIG. 5 is a plan view of a first side of the factory fixture frame depicted in FIG. 2, and showing additional details of indexing means and shadow mask tensing and clamping means.
Figure 6:
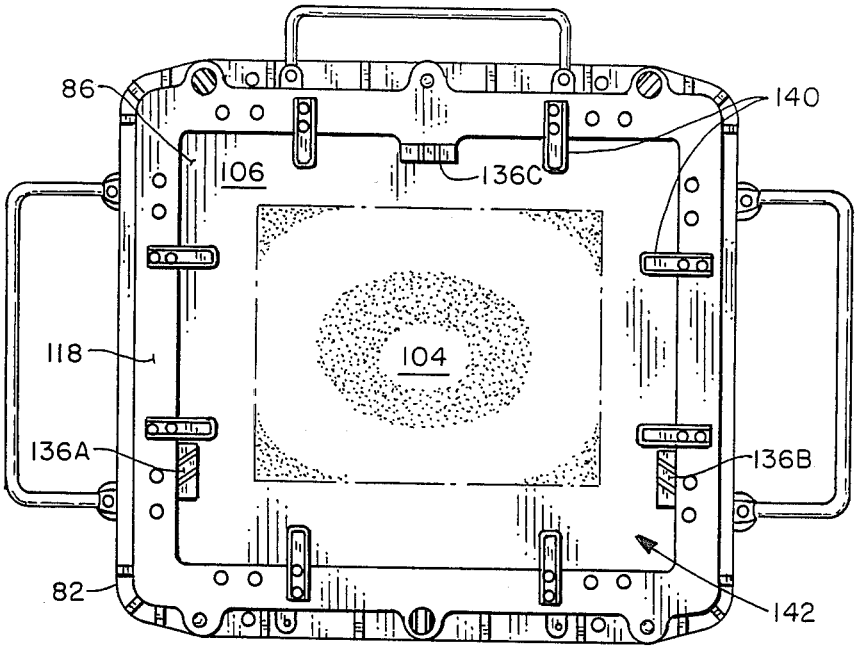
FIG. 6 is view similar to FIG. 5 depicting an opposite, or "second" side, of the factory fixture frame of FIG. 5.
Figure 7:
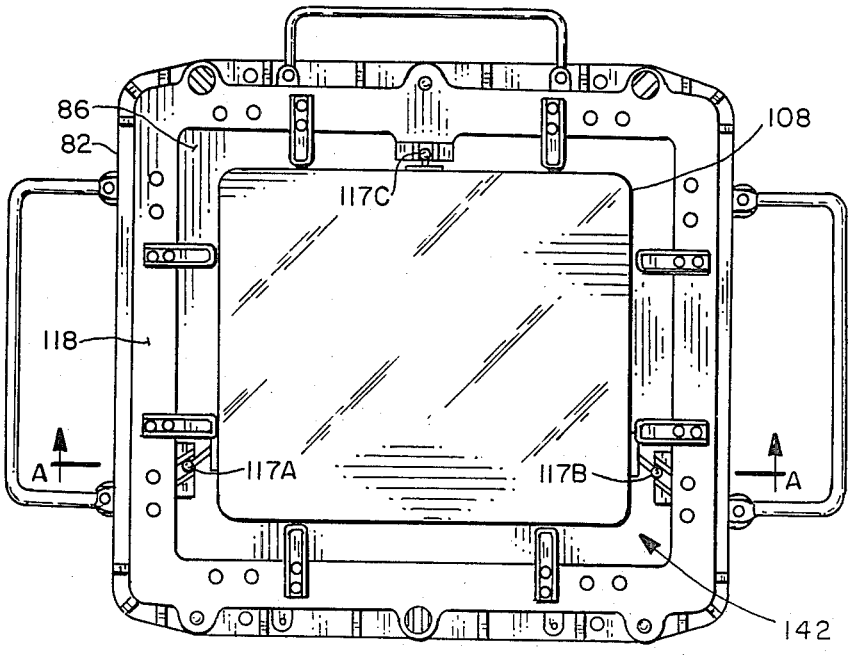
FIG. 7 is a view of the second side of the factory fixture frame depicted in FIG. 6, showing the installation of an in-process faceplate within the frame.
Figure 8:
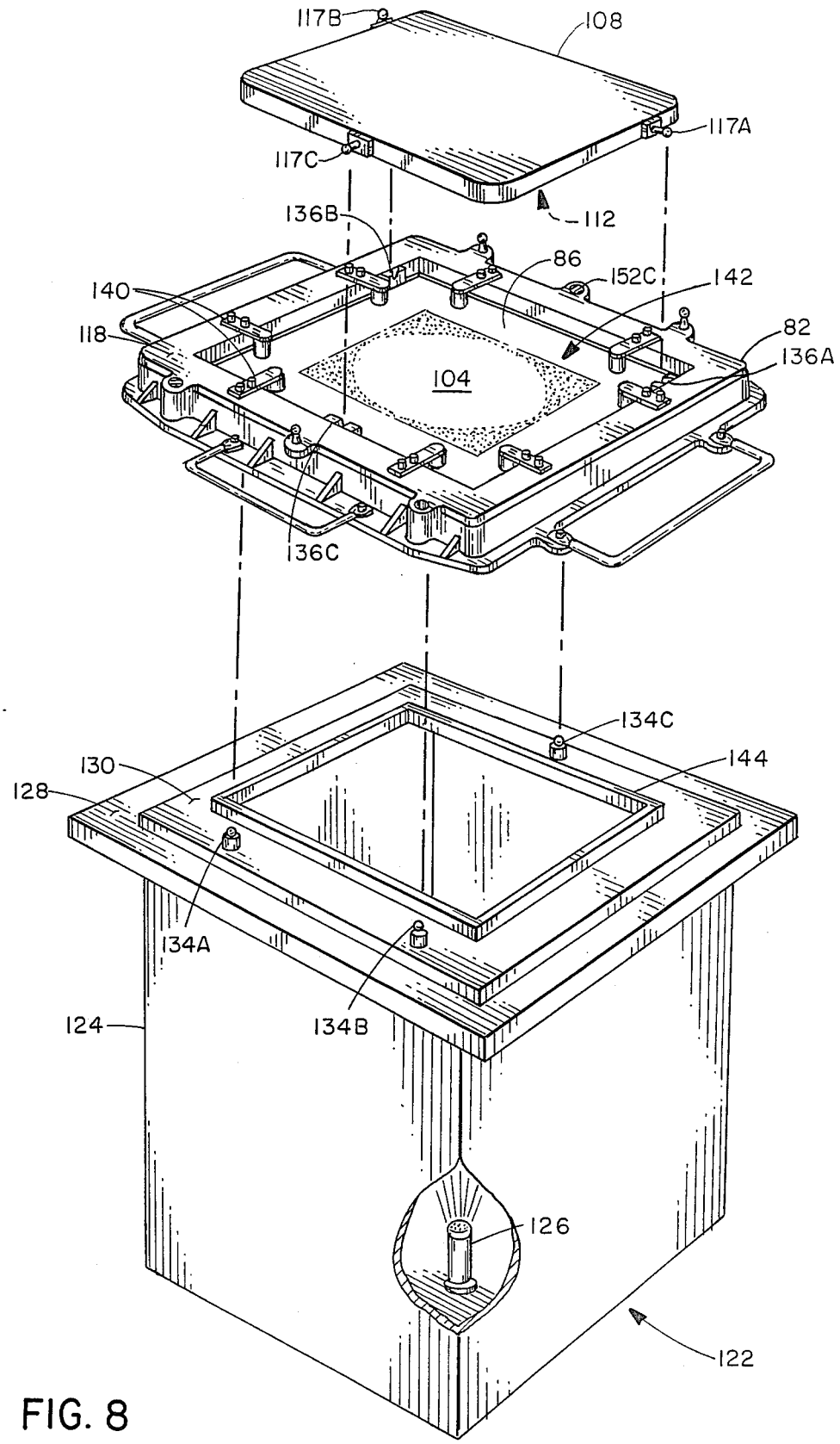
FIG. 8 is a perspective view of a photoexposure lighthouse used in the photoscreening process, with the base partly cut away, and with a factory fixture frame and an in-process faceplate indicated as being exploded therefrom.
Figure 10:
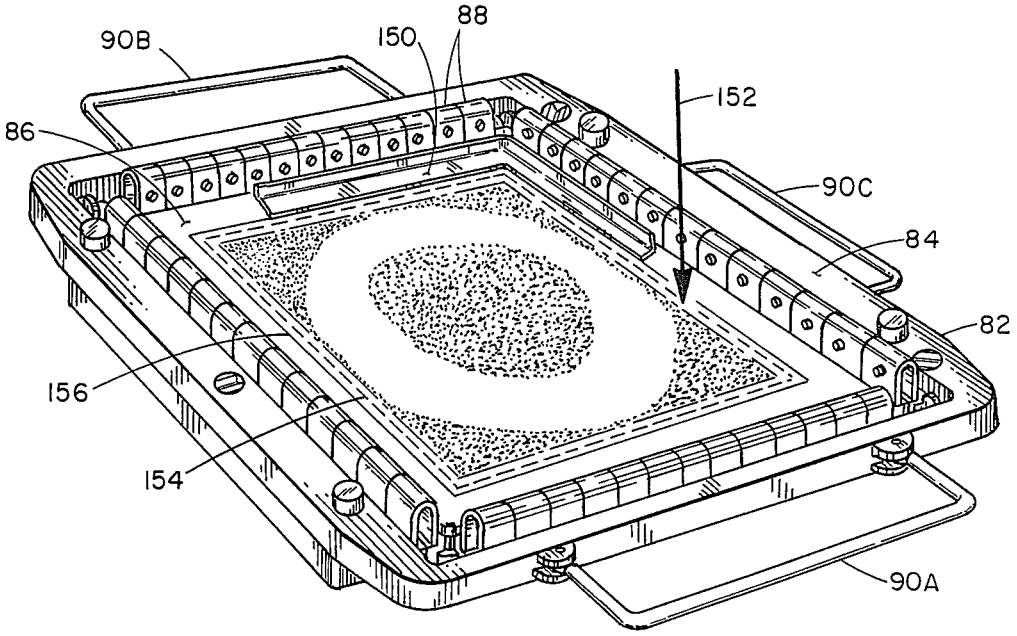
FIG. 10 is an oblique view in perspective of a factory fixture frame including negative interference fixturing means according to the invention for affixing a foil shadow mask to a support structure.

The factory fixture frame 84 depicted in FIGS. 5 and 6 has two sides of interest: a first side 84, indicated in FIGS. 2, 5 and 10, and a second side 118, indicated in FIGS. 6, 7 and 8. The factory fixture frame 82 is positioned relative to the faceplate 108 and the mask support structure 114 secured thereto such that the predetermined pattern of shadow mask apertures lies in precise registration with the screening area 112 of faceplate 108.

A photoexposure lighthouse 122 is illustrated diagrammatically in FIG. 8 as comprising a base 124 within which is a light source 126 that emits ultraviolet radiation to which the various screening fluids used in the faceplate photoscreening process are sensitized. The rays of the light source 126 typically pass through a correction lens and a neutral density filter (not shown) before reaching the shadow mask and the screening area of the faceplate. A table top 128 provides for mounting a platform 130 for receiving factory fixture frame 82.

The six-point indexing means are depicted by way of example as comprising ball-and-groove means located on the parts to be registered. Although ball-and-groove indexing means are indicated in the various examples as the means of indexing in this and in subsequent depictions, it is noted that other means of indexing may as well be used.

With reference to the first side 84 of factory fixture frame 82, depicted in FIG. 5, three groove means 132A, 132B and and 132C are shown; these groove means provide for registration with three ball means 134A, 134B and 134C located on platform 130 of lighthouse 122. As indicated by FIG. 8, the factory fixture frame 82 is lowered into registration with the lighthouse 122 for exposing the screening area of in-process faceplate 108 to radiation from light source 126.

Factory fixture frame 82 is shown in FIG. 6 as having on its second side 118, second six-point indexing means 136A, 136B and 136C, represented as being groove means, for registering with complementary registration-affording ball means 117A, 117B and 117C shown as extending from the sides of the in-process faceplate 108. Plastic guides 140, indicated as being eight in number, provide for initially guiding in-process faceplate 108 into recess 142 of factory fixture frame 82, with the final, precision registration being provided by the ball-and-groove means described. The faceplate 108 is lowered into the recess 142 in the factory fixture frame 82 such that the pretermined pattern of apertures of the underlying in-process shadow mask 86 are in precise registration with the screening area 112 of faceplate 108. The faceplate 108, as mounted in the recess 142 of factory fixture frame 82, is depicted in FIG. 7.

The first step in a multiple-step photoscreening process then follows. Prior to the installation of faceplate 108 in factory fixture frame 82 indicated by FIG. 7, a coating of a light-sensitive material is applied to the screening area 112 of faceplate 108; this coating becomes the "grille," or black surround.

With reference to FIG. 8, the factory fixture frame 82, with the in-process shadow mask mounted in tension therein, is installed on the platform 130 of lighthouse 122, with precise registration of the first side 84 of frame 82 being provided by groove means 132A, 132B and 132C in frame 82 in conjunction with ball means 134A, 134B and 134C shown as extending from lighthouse platform 130.

The screening area 112 of faceplate 108 is exposed to light actinic to the coating through the predetermined pattern of apertures in the in-process mask 86. Faceplate 108 is then removed from the factory fixture frame 82 to "develop" the coating on the screening area. As a result of this first step, the grille that is formed on the screening area 142 has three open areas in correlation to each aperture of the shadow mask. In successive repetitions of the photoscreening process, the respective openings sequentially receive discrete deposits of red-light-emitting, green-light-emitting and blue-light-emitting phosphors. For example, in the application of a red-light-emitting phosphor, the faceplate 108 is removed from factory fixture frame 82 and the screening area 112 receives a coating of a slurry which contains a phosphor that emits red light when excited by an electron beam. The faceplate 108 is again placed in the factory fixture frame 82 in precise registration with the in-process shadow mask 82, and the "red" phosphor coating is exposed to light projected through the apertures of the mask from a light source located at a position that corresponds to the emission point of the particular electron beam that is intended to excite the red-light-emitting phosphor. The light, in effect, "hardens" the phosphor so that it will remain in place during a subsequent washing process. The steps are repeated for the application of the green-light-emitting and blue-light-emitting phosphors.

Negative interference fixturing means according to the invention are provided for temporarily urging the shadow mask into uniform engagement with the mask support structure while maintaining precise registration with the screening area. To accomplish the necessary precision in registration, the six-point indexing means, described by way of example in this disclosure as being ball-and-groove means, must be unimpeded in seeking registration; that is, each ball must be able to seat itself exactly in its associated groove, and not become "hung up" due to some external influence. Such an external influence can comprise the frictional restraint that results when the shadow mask is placed in contact with the mounting surface of the mask support structure before the balls are fully seated in the grooves. To attain registration under this condition, the shadow mask must literally be dragged across the mounting surface. The resulting frictional restraint makes exact and consistent registration and re-registration difficult to attain. Precision registration is accomplished without frictional restraint by means of negative interference fixturing according to the invention, and registration of the shadow mask apertures with the screening area is maintained throughout the procedure to create a pattern of phosphor deposits on the screening area corresponding exactly to the pattern of the shadow mask apertures. Negative interference fixturing also ensure positive registration during the affixing of the shadow mask to the mask support structure, as will be shown and described.

Figure 9A:
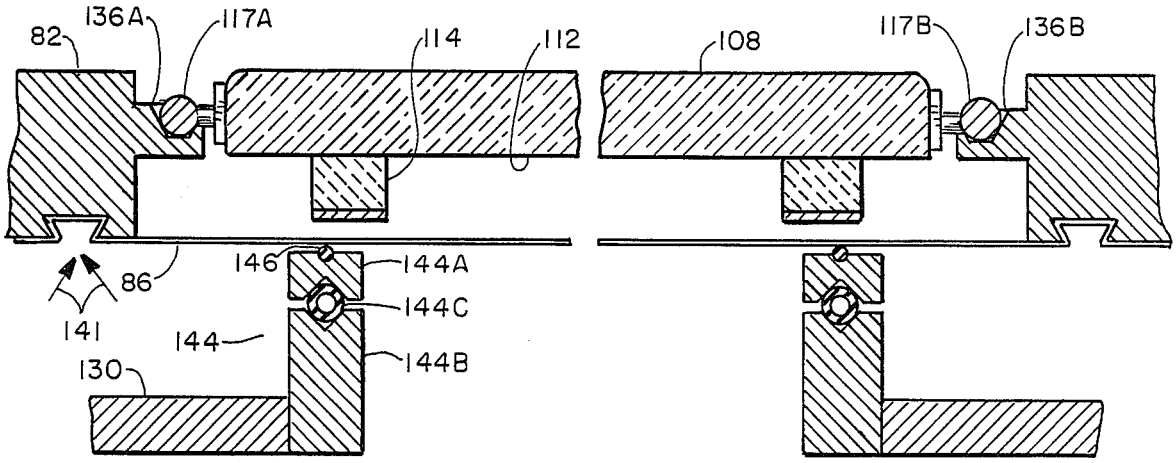
FIGS. 9A and 9B are elevational views in section taken along lines A—A of FIG. 7 that indicate the sequence of operation of the negative interference fixturing means and process according to the invention as used in photoscreening a faceplate.

A preferred means according to the invention for the temporary urging of the mask into uniform engagement with the mask support structure without frictional restraint comprises expansible and contractible means 144 indicated in FIG. 8 as being mounted within platform 130 of lighthouse 122. This embodiment of the invention and its function is represented in greater detail in FIGS. 9A and 9B wherein a shadow mask 86 is represented as being clamped in tension in frame 82; the clamping is indicated schematically by arrows 141. The expansible and contractible means 144 are represented schematically as comprising two parts 144A and 144B having entrapped therebetween a flexible pneumatic tubing 144C, indicated as being in a contracted state. A mask-contacting member 146 is depicted as being embedded atop part 144A; this ring may comprise an O-ring made of rubber. In FIG. 9A, flexible pneumatic tubing 144C is represented as being contracted. As a result, shadow mask 86 is in a proximate, but negative interference relationship with mask support structure 114 according to the invention; that is, in close proximity to, but not touching the mask mounting surface 116 of structure 114. (Note: the distance indicated between shadow mask 86 and the mask mounting surface 116 is exaggerated for illustrative purposes; the actual distance between mask 86 and mounting surface 116 is on the order of 0.005–0.015 inch, by way of example. The distance need only be sufficient to ensure that there is no frictional constraint that would impede the indexing means in the registration of the mask with the faceplate.)

Figure 9B:
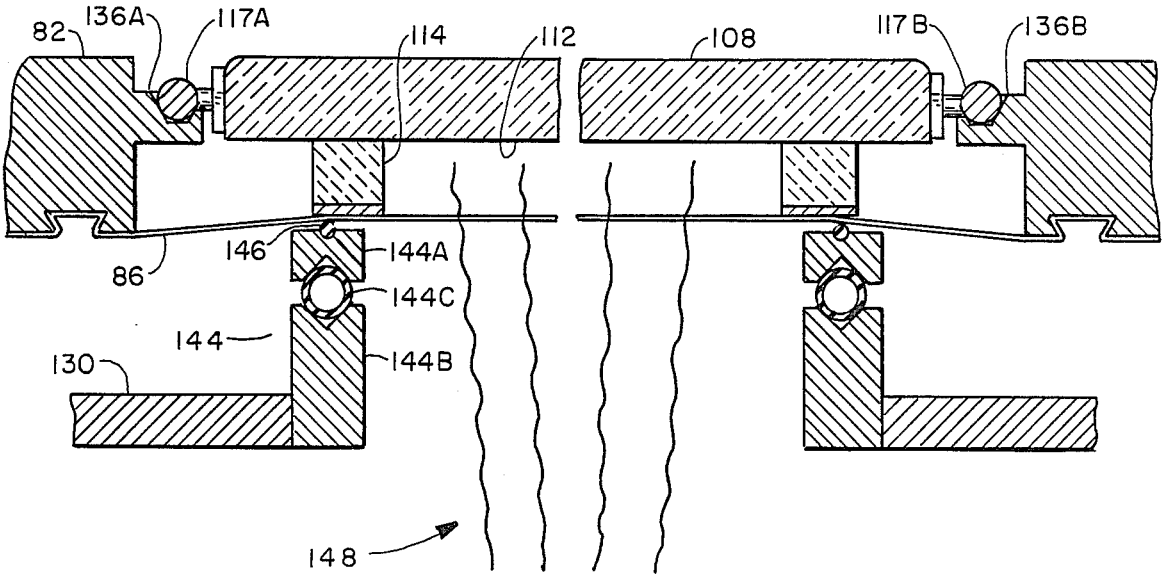

With reference to FIG. 9B, flexible pneumatic tubing 144C is depicted as having been expanded so that mask-contacting member 146 is pressing against mask 86. As a result, shadow mask 86 is urged into uniform engagement with the mask mounting surface 116 of support structure 114. Precise registration of the shadow mask 86 with screening area 112 according to the invention is thus maintained. Irradiation of the screening area 112 by light from light source 126 of lighthouse 122 is indicated by rays 148. The expansion and contraction of the flexible pneumatic tubing may be by means of a suitable air pump with a valve-controlled air outlet.

It is to be noted that means other than flexible tubing may be used—means that will suggest themselves to those skilled in the art. The benefit of the pneumatic tubing is that it ensures uniform pressure.

The foregoing steps are repeated to deposit the green-light-emitting phosphor and the blue-light-emitting phosphor in the respective openings in the grille. At least four such engagements and disengagements of the mask are required in the photoscreening process. The final product is a faceplate having on its screening area 112 a pattern of groups of phosphor dots or lines capable of emitting upon excitation by electron beams, red, green or blue light. By the means and process according to the invention, the registration of the shadow mask apertures with the screening area is maintained throughout the procedure to create a pattern of phosphor deposits on the screening area corresponding to the pattern of shadow mask apertures. It is to be noted that, in this process, an in-process shadow mask is typically "mated" with an in-process faceplate; that is, the same mask is used in the photoscreening of a particular faceplate, and is permanently installed in conjunction with the faceplate in final assembly.

Upon completion of the photoscreening process, the in-process shadow mask 86 is affixed to the shadow mask support structure 114 and the mask is severed from the factory fixture frame 82. The negative interference fixturing means according to the invention is also preferred for use in mask affixation and severing, as will be described. The affixing of the mask 86 relative to the face-plate, and removal from the factory fixture frame is preferably accomplished by the process fully described and claimed in referent copending application Ser. No. (58,095), of common ownership herewith. Parts of the referent (58,095) process relevant to the present invention are described as follows.

FIG. 10 depicts the factory fixture frame 82 following the photoscreening process. It will be noted that the first side 84 of frame 82 is now in an upward orientation, while the in-process faceplate 108 (not visible in the figure) remains mounted in precise registration with shadow mask 86, as is depicted in FIG. 7. This relationship is represented diagrammatically by figures 11A and 11B. As indicated by figure 11A, shadow mask 86 is in a proximate, but negative interference relationship with mask support structure 114 according to the invention; that is, in close proximity to, but not touching the mask mounting surface 116 of mask support structure 114.

Figure 11A:
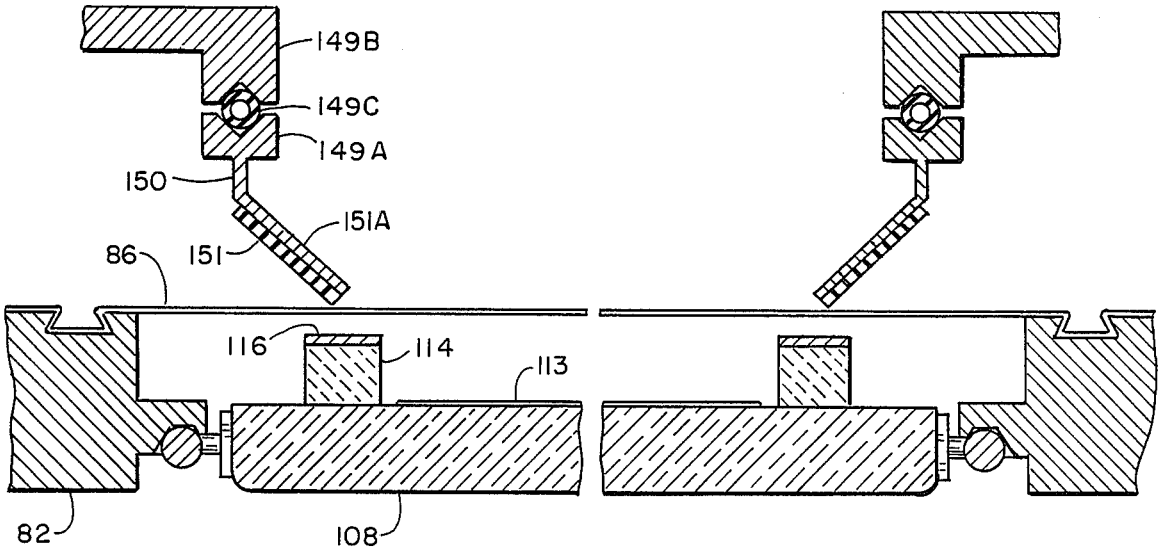
FIGS. 11A and 11B are elevational views in section similar to FIGS. 9A and 9B, and also taken along lines A—A of FIG. 7, that indicate the sequence of operation of the negative interference fixturing means and process according to the invention for affixing a shadow mask to a mask support structure.

A preferred means for urging the shadow mask 86 into contact with the mask-mounting surface 116 of mask support 114 is indicated schematically as comprising a two-part expansible-contractible means 149 similar to the means 144 depicted in FIGS. 9A and 9B; that is, parts 149A and 149B have entrapped therebetween a flexible pneumatic tubing 149C, indicated as being in a contracted state in figure 11A.

Figure 11B:
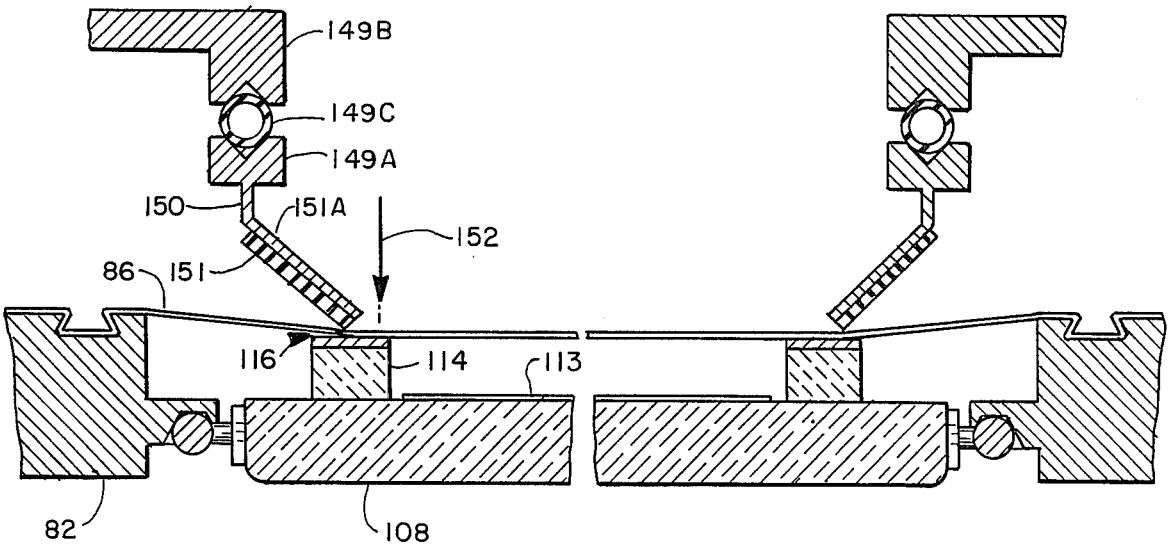

With reference to figure 11B, shadow mask 86 is depicted as having been urged into uniform engagement with support structure 114 by knife-edge means 150, depicted highly schematically. A phosphor-bearing screen 113, which is the product of the previous photoscreening process, is indicated. The knife-edge means 150 provide for pushing mask 86 into intimate contact with the mask mounting surface 116 of mask support structure 114. Precise registration of the shadow mask 86 with screening area 112 according to the invention is thus maintained. The knife-edge means 150 may comprise, by way of example, a fixture having a foot indicated symbolically as including a rubber member 151 in the form of a rectangle supported by a metal shoe 151A; the toe of rubber member 151 is depicted as pressing against the metal of the mask 86. Knife-edge means 150 provides gentle, uniform pressure against mask 86 to ensure positive, overall contact of the mask 86 with the mask-receiving surface 116. Such positive contact is a requisite to proper welding.

According to the aforementioned (58,095) disclosure, the in-process mask 86, still clamped in tension in the factory fixture frame 82, is affixed to support structure 114. The means of affixing the mask 82 to the mask support structure 116 is preferably spot welding by a laser beam, indicated diagrammatically by arrow 152. The weld path 154 is indicated by the dash line. Upon completion of the welding, the power of laser beam is lowered and the frame 106 of unperforated metal is severed by the same beam at a sever line 156, indicated as being located immediately outside of the periphery of the weld path. As a result and according to the invention, the registration of the pattern of shadow mask apertures with the screen 113 is maintained during the affixing of the shadow mask to the mask support structure. Means are provided of course for retracting the knife-edge means following the welding operation.

Upon completion of the trimming operation, the in-process shadow mask 86, affixed to mask support structure 146, is free of the factory fixture frame 82, and the assembly is a viable faceplate assembly complete with a screen 113, and ready for attachment to a funnel. Attachment of the faceplate assembly to a funnel is depicted in FIG. 1.

The ball means 117A, 117B and 117C, indicated as extending from the sides of faceplate 108, comprise temporary indexing means. The cement used for attachment of the temporary indexing means is of the type that becomes non-adherent as the frit cycle temperature of 435 degrees C. is approached. As a result, the ball means fall away from the faceplate at the time of final assembly. This concept of temporary attachment of the indexing balls to the faceplate, and the means therefore, is described and claimed in referent copending application Ser. No. (131,968), of common ownership.

A process of negative interference fixturing for multiple registrations of a tensed foil shadow mask with the screening area of a faceplate to create a pattern of phosphor deposits comprises the following— providing a foil shadow mask having a pattern of apertures corresponding to the pattern of phosphor deposits;

providing shadow mask mounting means for mounting and locating the mask in tension in a proximate, but negative interference relationship with the mask support structure; positioning the mounting means relative to the faceplate and the support structure such that the predetermined pattern of apertures lies in precise registration with the screening area;

urging the shadow mask into uniform engagement with the support structure while maintaining the precise registration with the screening area;

whereby, precise registration of the screening area of the faceplate with the shadow mask apertures is accomplished without frictional constraint between the shadow mask support structure and the mask, and the registration of the shadow mask apertures with the screening area is maintained throughout the photoexposure process to create a pattern of phosphor deposits on the screening area corresponding exactly to the pattern of the shadow mask apertures.

The process of negative interference fixturing according to the invention may include the steps of affixing the shadow mask to a mask support structure, and severing the mask from its mounting frame, as has been described. The means of registration has been described as comprising six-point indexing means.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

What is claimed is:

1. Negative interference fixturing means for use in the photoexposure of an in-process faceplate assembly for a color cathode ray tube, said assembly including a flat glass faceplate having on its inner surface a centrally disposed screening area for receiving a predetermined pattern of phosphor deposits, a shadow mask having a pattern of apertures corresponding to said pattern of phosphor deposits, and a shadow mask support structure located on opposed sides of said screening area for supporting said mask in tension, said negative interference fixturing means comprising:

shadow mask mounting means for mounting and locating said mask in tension in a proximate, but negative interference relationship with said mask support structure;

means for installing said faceplate on a photoexposure lighthouse in conjunction with said shadow mask mounting means, and for positioning said mounting means relative to said faceplate and said support structure such that said predetermined pattern of shadow mask apertures lies in precise registration with said screening area;

means for temporarily urging said shadow mask into uniform engagement with said support structure while maintaining said precise registration with said screening area;

means for photoexposing said screening area;

whereby, precise registration of the screening area of the faceplate with the shadow mask apertures is accomplished without frictional constraint between the shadow mask support structure and the mask, and the registration of the shadow mask apertures with the screening area is maintained throughout the photo-exposure process to create a pattern of phosphor deposits on the screening area corresponding exactly to the pattern of the shadow mask apertures.

2. The negative interference fixturing means according claim 1 wherein said means for temporarily urging said shadow mask into uniform engagement with said support structure comprises expansible and contractible means.

3. The negative interference fixturing means according to claim 2 wherein said expansible and contractible means comprises flexible pneumatic tubing.

4. Negative interference fixturing means for use in affixing a shadow mask to a mask support structure during the manufacture of an in-process faceplate assembly for a color cathode ray tube, said assembly including a flat glass faceplate having on its inner surface a centrally disposed screen with a predetermined pattern of phosphor deposits, a foil shadow mask having a pattern of apertures corresponding to said pattern of phosphor deposits, and a shadow mask support structure located on opposed sides of said screen for supporting said mask, said negative interference fixturing means comprising:

shadow mask mounting means for mounting and locating said mask in tension in a proximate, but negative interference relationship with said mask support structure;

means for positioning said shadow mask mounting means in exact relationship to said faceplate and said support structure such that said predetermined pattern of apertures of said mask lie in precise registration with said predetermined pattern of phosphor deposits;

means for temporarily urging said shadow mask into uniform engagement with said support structure while maintaining said precise registration of said apertures of said mask with said pattern of phosphor deposits;

means for affixing said mask to said support structure;

whereby, precise registration of the screening area of the faceplate with the shadow mask apertures is accomplished without frictional constraint between the shadow mask support structure and the mask, and the registration of the shadow mask apertures with the screening area is maintained during the affixing of the mask to the mask support structure.

5. The negative interference fixturing means according to claim 4 wherein said means for temporarily urging said mask into uniform engagement with said support structure while maintaining said precise registration comprises knife-edge means for pushing said mask into intimate contact with said support structure.

6. The negative interference fixturing means according to claim 4 wherein said means for positioning said shadow mask mounting means in exact relationship to said faceplate and said support structure comprise six-point indexing means.

7. Negative interference fixturing means for use in affixing a shadow mask to a mask support structure during the manufacture of an in-process faceplate assembly for a color cathode ray tube, said assembly including a flat glass faceplate having on its inner surface a centrally disposed screen with a predetermined pattern of phosphor deposits, a foil shadow mask having a pattern of apertures corresponding to said pattern of phosphor deposits, and a shadow mask support structure located on opposed sides of said screen for supporting said mask, said negative interference fixturing means comprising:

shadow mask mounting means for mounting and locating said mask in tension in a proximate, but negative interference relationship with said mask support structure;

six-point indexing means for positioning said shadow mask mounting means in exact relationship to said faceplate and said support structure such that said predetermined pattern of apertures of said mask lie in precise registration with said predetermined pattern of phosphor deposits;

means for temporarily urging said shadow mask into uniform engagement with said support structure while maintaining said precise registration of said apertures of said mask with said pattern of phosphor deposits;

means for affixing said mask to said support structure;

whereby, precise registration of the screening area of the faceplate with the shadow mask apertures is accomplished without frictional constraint between the shadow mask support structure and the mask, and the registration of the shadow mask apertures with the screening area is maintained during the affixing of the mask to the mask support structure.

8. For use in the manufacture of a faceplate assembly for a color cathode ray tube including a flat glass faceplate having a screening area on its inner surface, and a shadow mask support structure located on opposed sides of said screen for supporting a tension foil shadow mask, a negative interference fixturing process for multiple inter-registrations of said shadow mask with said screening area to create a pattern of phosphor deposits, the process comprising:

providing a foil shadow mask having a pattern of apertures corresponding to said pattern of phosphor deposits;

providing shadow mask mounting means for mounting and locating said mask in tension in a proximate, but negative interference relationship with said mask support structure; positioning said mounting means relative to said faceplate and said support structure such that said predetermined pattern of apertures lies in precise registration with said screening area;

urging said shadow mask into uniform engagement with said support structure while maintaining said precise registration with said screening area;

whereby, precise registration of the screening area of the faceplate with the shadow mask apertures is accomplished without frictional constraint between the shadow mask support structure and the mask, and the registration of the shadow mask apertures with the screening area is maintained throughout the procedure to create a pattern of phosphor deposits on the screening area corresponding exactly to the pattern of the shadow mask apertures.

9. The negative interference fixturing process according to claim 8 including the step of affixing said mask to said mask support structure.

10. The negative interference fixturing process according to claim 8 including the step of photoexposing said screening surface.

11. For use in the manufacture of a faceplate assembly for a color cathode ray tube including a flat glass faceplate having on its inner surface a centrally disposed screening surface for receiving a predetermined pattern of phosphor deposits, and a shadow mask support structure located on opposed sides of said screen for supporting a tension foil shadow mask in precise registration with said screen and at a predetermined distance therefrom, a negative interference fixturing process for photoexposing said screening area, comprising:

providing a foil shadow mask having a pattern of apertures corresponding to said pattern said phosphor deposits;

providing shadow mask mounting means for mounting and locating said mask in tension in a proximate, but negative interference relationship with said mask support structure; installing said faceplate on a photoexposure light-house in conjunction with said shadow mask mounting means;

positioning said shadow mask mounting means in exact relationship with said faceplate and said support structure such that said predetermined pattern of apertures lies in precise registration with said predetermined pattern of phosphor deposits;

urging said shadow mask into uniform engagement with said support structure while maintaining said precise registration; and photoexposing said screening area;

whereby, precise registration of the screening area of the faceplate with the shadow mask apertures is accomplished without frictional constraint between the shadow mask support structure and the mask, and the registration of the shadow mask apertures with the screening area is maintained throughout the photoscreening process to create a pattern of phosphor deposits on the screening area corresponding exactly to the pattern of the shadow mask apertures.

12. The negative interference fixturing process according to claim 11 wherein said mask is urged into contact with said support structure by expansible and contractible means.

13. The negative interference fixturing process according to claim 11 wherein said mask is urged into contact with said support structure by the expansion of flexible pneumatic tubing.

14. For use in the manufacture of a faceplate assembly for a color cathode ray tube including a flat glass faceplate having on its inner surface a centrally disposed screen including a predetermined pattern of phosphor deposits, and a shadow mask support structure located on opposed sides of said screen for supporting a tension foil shadow mask in precise registration with said screen and at a predetermined distance therefrom, a negative interference fixturing process for affixing a shadow mask to said support structure, comprising:

providing a foil shadow mask having a pattern of apertures corresponding to said pattern said phosphor deposits;

providing shadow mask mounting means for mounting and locating said mask in tension in a proximate, but negative interference relationship with said mask support structure; positioning said shadow mask mounting means in exact relationship with said faceplate and said support structure such that said predetermined pattern of apertures lies in precise registration with said predetermined pattern of phosphor deposits;

urging said shadow mask into uniform engagement with said support structure while maintaining said precise registration; and affixing said mask to said support structure;

whereby, precise registration of the screening area of the faceplate with the shadow mask apertures is accomplished without frictional constraint between the shadow mask support structure and the mask, and the registration of the shadow mask apertures with the screening area is maintained during the affixing of the mask to the mask support structure.

15. The negative interference fixturing process according to claim 14 wherein said mask is pushed into uniform engagement with said mask support structure by knife-edge means.

16. The negative interference fixturing process according to claim 15 wherein said knife-edge means comprises a rubber member.

17. The negative interference fixturing process according to claim 14 wherein said shadow mask mounting means is positioned in exact relationship to said faceplate by six-point indexing means.

18. For use in the manufacture of a faceplate assembly for a color cathode ray tube including a flat glass faceplate having on its inner surface a centrally disposed screening surface for receiving a predetermined pattern of phosphor deposits, and a shadow mask support structure located on opposed sides of said screen for supporting a tension foil shadow mask in precise registration with said screen and at a predetermined distance therefrom, a negative interference fixturing process for photoexposing said screening area, comprising:

providing a foil shadow mask having a pattern of apertures corresponding to said pattern said phosphor deposits;

providing shadow mask mounting means for mounting and locating said mask in tension in a proximate, but negative interference relationship with said mask support structure; installing said faceplate on a photoexposure lighthouse in conjunction with said shadow mask mounting means;

positioning said shadow mask mounting means in exact relationship with said faceplate and said support structure by six-point indexing means such that said predetermined pattern of apertures lies in precise registration with said predetermined pattern of phosphor deposits;

urging said shadow mask into uniform engagement with said support structure while maintaining said precise registration by using expansible and contractible means comprising flexible pneumatic tubing; and photoexposing said screening area;

whereby, precise registration of the screening area of the faceplate with the shadow mask apertures is accomplished without frictional constraint between the shadow mask support structure and the mask, and the registration of the shadow mask apertures with the screening area is maintained throughout the photo-exposure process to create a pattern of phosphor deposits on the screening area corresponding exactly to the pattern of the shadow mask apertures.

19. For use in the manufacture of a faceplate assembly for a color cathode ray tube including a flat glass faceplate having on its inner surface a centrally disposed screen including a predetermined pattern of phosphor deposits, and a shadow mask support structure located on opposed sides of said screen for supporting a tension foil shadow mask in precise registration with said screen and at a predetermined distance therefrom, a negative interference fixturing process for affixing a shadow mask to said support structure, comprising:

providing a foil shadow mask having a pattern of apertures corresponding to said pattern said phosphor deposits;

providing shadow mask mounting means for mounting and locating said mask in tension in a proximate, but negative interference relationship with said mask support structure; positioning said shadow mask mounting means in exact relationship with said faceplate and said support structure by six-point indexing means such that said predetermined pattern of apertures lies in precise registration with said predetermined pattern of phosphor deposits;

urging said shadow mask into uniform engagement with said support structure while maintaining said precise registration by knife-edge means having the form of a rubber member; and affixing said mask to said support structure;

whereby, precise registration of the screening area of the faceplate with the shadow mask apertures is accomplished without frictional constraint between the shadow mask support structure and the mask, and the registration of the shadow mask apertures with the screening area is maintained during the affixing of the shadow mask to the mask support structure.

* * * * *